US011777211B2

(12) United States Patent
Cheng et al.

(10) Patent No.: US 11,777,211 B2
(45) Date of Patent: Oct. 3, 2023

(54) IMPEDANCE MATCHING METHOD FOR LOW-PROFILE ULTRA-WIDEBAND ARRAY ANTENNA

(71) Applicant: Hangzhou Dianzi University, Hangzhou (CN)

(72) Inventors: Zhiqun Cheng, Hangzhou (CN); Peng Gao, Hangzhou (CN); Ruoyu He, Hangzhou (CN); Zhen Wang, Hangzhou (CN)

(73) Assignee: Hangzhou Dianzi University, Hangzhou (CN)

( * ) Notice: Subject to any disclaimer, the term of this patent is extended or adjusted under 35 U.S.C. 154(b) by 315 days.

(21) Appl. No.: 17/381,662

(22) Filed: Jul. 21, 2021

(65) Prior Publication Data

US 2022/0149524 A1 May 12, 2022

(30) Foreign Application Priority Data

Nov. 12, 2020 (CN) ..... 202011261301.1

(51) Int. Cl.

| | |
|---|---|
| ***H01Q 5/335*** | (2015.01) |
| ***H01Q 19/10*** | (2006.01) |
| ***H01Q 9/26*** | (2006.01) |
| ***H01Q 5/10*** | (2015.01) |

(52) U.S. Cl.

CPC ..... *H01Q 5/335* (2015.01); *H01Q 9/26* (2013.01); *H01Q 19/108* (2013.01); *H01Q 5/10* (2015.01)

(58) Field of Classification Search

CPC ..... H01Q 1/50; H01Q 5/10; H01Q 5/335; H01Q 9/26; H01Q 19/108

See application file for complete search history.

(56) References Cited

U.S. PATENT DOCUMENTS

| | | | | |
|---|---|---|---|---|
| 10,320,088 | B1 * | 6/2019 | Johnson | H01Q 21/062 |
| 2009/0015502 | A1 * | 1/2009 | Haapala | H01Q 9/16 343/795 |
| 2010/0225554 | A1 * | 9/2010 | Huang | H01Q 15/0086 343/859 |
| 2011/0043432 | A1 * | 2/2011 | Ineichen | H01Q 1/38 343/876 |

OTHER PUBLICATIONS

R. He et al., "A 1×8 Linear Ultra-Wideband Phased Array With Connected Dipoles and Hyperbolic Microstrip Baluns," in IEEE Access, vol. 6, pp. 52953-52968, 2018 (Year: 2018).*

* cited by examiner

*Primary Examiner* — Ricardo I Magallanes
*Assistant Examiner* — Amal Patel
(74) *Attorney, Agent, or Firm* — M&B IP Analysts, LLC

(57) ABSTRACT

An impedance matching method for a low-profile ultra-wideband array antenna is provided. The method includes: connecting an arm of a balanced end of a hyperbolic microstrip balun in series with an open circuit line; directly coupling the open circuit line to a radiator layer; connecting another arm of the balanced end of the hyperbolic microstrip balun to the radiator layer via a metallized via hole, and welding an unbalanced end of the hyperbolic microstrip balun to a coaxial line, so that the coaxial line feeds a power to the antenna via the hyperbolic microstrip balun. In this method, the open circuit line is integrated between the hyperbolic microstrip balun and the radiator layer of the antenna to achieve an impedance matching of the ultra-wideband antenna and to simplify a structure of a matching circuit.

5 Claims, 10 Drawing Sheets

IMPEDANCE MATCHING METHOD FOR LOW-PROFILE ULTRA-WIDEBAND ARRAY ANTENNA

CROSS REFERENCE TO RELATED APPLICATION

This patent application claims the benefit and priority of Chinese Patent Application No. 202011261301.1 filed on Nov. 12, 2020, the disclosure of which is incorporated by reference herein in its entirety as part of the present application.

TECHNICAL FIELD

The present disclosure relates to a technical field of antennas, and specifically, to an impedance matching method for a low-profile ultra-wideband array antenna.

BACKGROUND ART

In recent years, with developments of ultra-wideband phased array radars and wireless communications systems, phased array antennas with a broadband, a wide-angle scan, a low profile, a low cross-polarization, and a high gain have becoming a research hot spot. A traditional design method for an ultra-wideband array antenna is to design antenna elements with wideband characteristics, and then combine them to an array. However, due to a mutual coupling effect between array elements, the wideband characteristics deteriorate much. To solve a problem existing in the ultra-wideband array antenna design, a brand new ultra-wideband antenna design concept, called a tightly coupled array, is proposed. The tightly coupled array may offset an influence from an inductance between the antenna and a floor with the mutual coupling between the array elements, instead of adjusting or suppressing reflections between ground planes. This design method marks a revolutionary breakthrough in the wideband array antennas design. However, there are some key challenges need to be addressed to implement the tightly coupled array antenna with many ideal characteristics, for example, a matching network with a same bandwidth is required to effectively realize the bandwidth of the array, so as to achieve an impedance transformation and a conversion process from a balance to nonbalance.

To promote the development of the tightly coupled ultra-wideband array antennas, various feed methods have been proposed, such as commercial passive baluns. However, the commercial passive baluns generally have a narrow bandwidth, and are relatively heavy and expensive. In contrast, active baluns have a narrow application range because the active baluns are usually only suitable for receiving systems. To maximize the bandwidth, some matching circuits use a heavy external balun and a 180-degree mixer under the ground plane, which increases an overall size and costs of the array antenna. A tightly coupled dipole array with an integrated Marchand balun (TCDA-IB) achieves a large bandwidth without using the heavy external balun, but the matching circuit uses a complex multilayer structure in which different line layers are connected via multiple via holes, making the processing more complex.

Considering the broadband a large impedance span, and a high frequency of the ultra-wideband array antenna, and matching methods of a narrowband and lumped circuit is not suitable for the impedance matching of broadband antennas, researchers have successively proposed some methods for the impedance matching of the ultra-wideband antennas to adapt to the development of the broadband antennas. However, limited by a process difficulty, such as a multi-layer structure design, or a necessity of adding an extra heavy 180° mixer, these methods cannot be widely used. To achieve the impedance matching of the low-profile ultra-wideband array antennas and realize a rapid development of the ultra-wideband array antennas, a new impedance matching method for the low-profile ultra-wideband array antenna is required.

SUMMARY

To solve the above problems, the present disclosure connects a hyperbolic microstrip balun in series with an open circuit line, directly couples the open circuit line to a radiator layer of an antenna for matching, and uses an arm of an array element as a ground for both the radiator layer and the open circuit line. In this way, the open circuit line is integrated into a matching circuit without adding any other dielectric layer, thereby keeping the array antenna elements compact, small, and cost-effective. In addition, due to its special structure, the hyperbolic microstrip balun can achieve a balance-nonbalance conversion while achieving an impedance transformation. Theoretically, the hyperbolic microstrip balun may realize the impedance transformation between any two impedances, and may be used for the impedance matching in a broadband.

The present disclosure provides an impedance matching method for a low-profile ultra-wideband array antenna, including a hyperbolic microstrip balun, a radiator layer, an open circuit impedance, and a coaxial line. The method includes: connecting an arm of a balanced end of the hyperbolic microstrip balun in series with the open circuit line, directly coupling the open circuit line to the radiator layer, connecting another arm of the balanced end of the hyperbolic microstrip balun to the radiator layer via a metallized via hole, and welding an unbalanced end of the hyperbolic microstrip balun to the coaxial line, so that the coaxial line feeds a power to the antenna via the hyperbolic microstrip balun.

In an embodiment, the arm of the balanced end of the hyperbolic microstrip balun is connected in series with the open circuit line, and the open circuit line is directly coupled to the radiator layer, to form an impedance matching circuit.

In an embodiment, the open circuit line and the radiator layer share a same dielectric layer.

In an embodiment, the open circuit line and the radiator layer are electromagnetically coupled.

In an embodiment, the hyperbolic microstrip balun has a curvilinear structure.

The present disclosure has at least the following beneficial effects.

1. The wideband matching circuit is simple, with the hyperbolic microstrip balun connected in series with the open circuit, without using a complicated matching circuit.
2. The arm of the array antenna element serves as the ground for both the radiator layer and the open circuit line, and the radiator layer and the open circuit line share one dielectric plate, reducing the processing difficulty and material costs.
3. A size of the open circuit line may be selected flexibly, and a characteristic impedance and a length of the open circuit line may be flexibly adjusted based on an impedance response of the array element.
4. Due to the special structure of the hyperbolic microstrip balun, i.e., a curvilinear structure, with a balanced structure at one end and an unbalanced structure at the other end, the impedance matching may be achieved in the broadband, and a conversion from a balanced end (the antenna) to an unbalanced end (the coaxial line) may also be achieved.

In the figures, there are: an input impedance;

a 50Ω port, which represents a port impedance of 50 Ω;

a resistance;

a reactance;

a radiator, which represents the radiator layer;

a open circuit, which represents the open circuit line; and a hyperbolic microstrip balun.

DETAILED DESCRIPTION OF THE EMBODIMENTS

To make the objectives, technical solutions, and advantages of the present disclosure clearer, the present disclosure is further described in detail below with reference to the accompanying drawings and embodiments. It should be understood that the specific embodiments described herein are merely intended to illustrate the present disclosure and are not intended to limit the present disclosure.

Instead, any substitution, modification, equivalent methods and solutions defined by the claims within the spirit and scope of the present disclosure may be covered by the present disclosure. Further, for better understanding of the present disclosure, some specific details of the present disclosure are described in detail below. Those skilled in the art may fully understand the present disclosure without these specific details.

Figure 1:
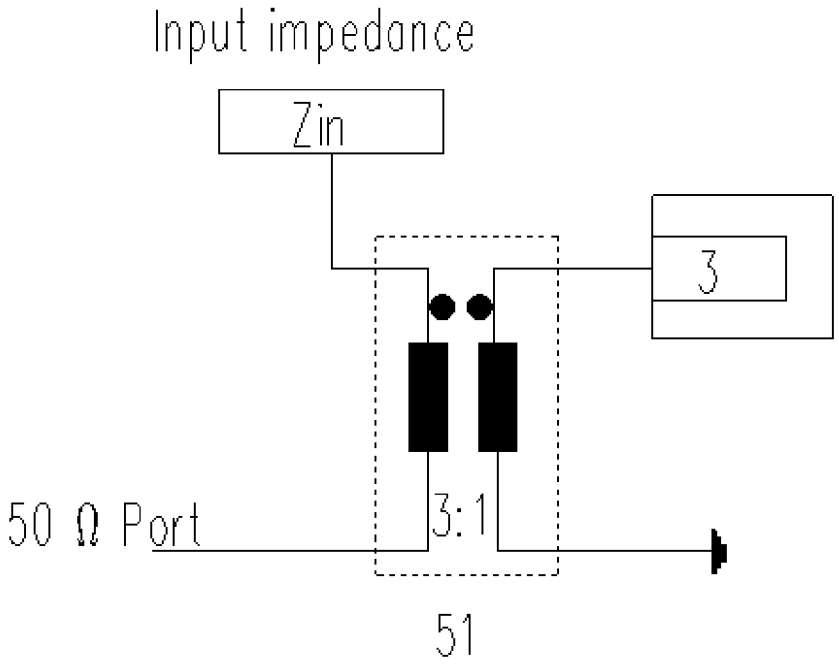
FIG. 1 is a schematic diagram of an impedance matching circuit of an ultra-wideband array antenna element according to an embodiment of the present disclosure.
Figure 2:
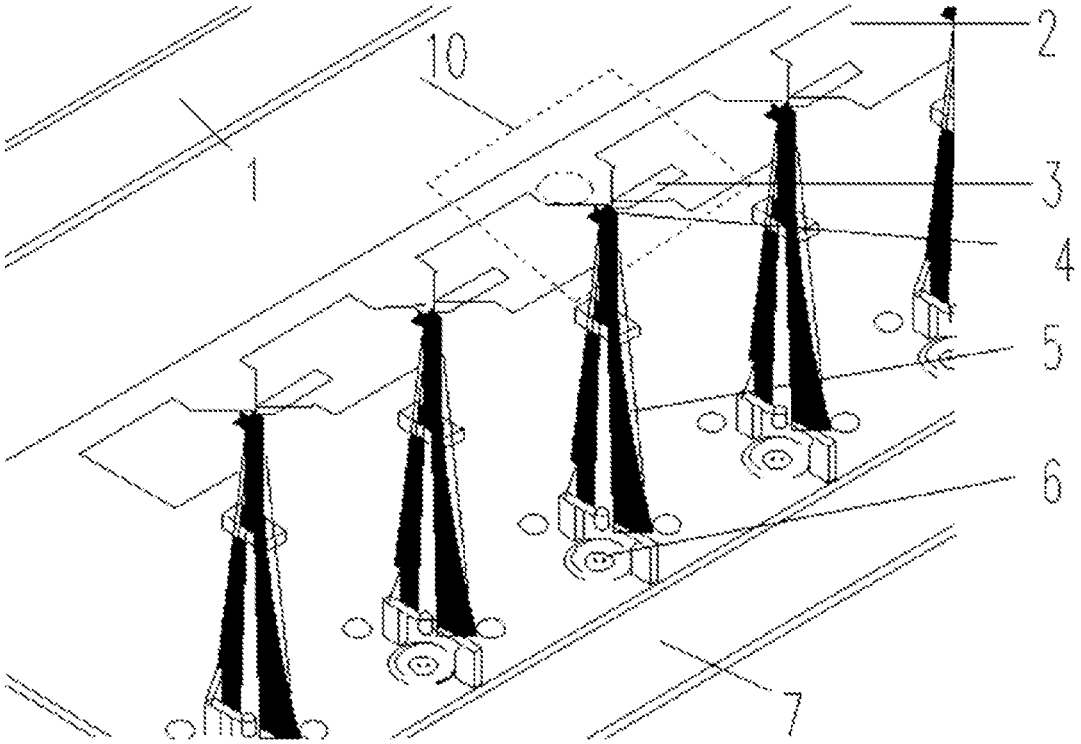
FIG. 2 is a schematic structural diagram of an impedance matching method for an ultra-wideband array antenna according to an embodiment of the present disclosure.

FIG. 1 is a schematic diagram of an impedance matching circuit of an ultra-wideband antenna element according to an embodiment of the present disclosure. Wherein, Zin is an input impedance of an antenna. Once a structure, a dimensions, and a frequency range of the antenna are determined, the impedance of the antenna may be considered as a fixed load of the circuit. The fixed load usually contains a fixed reactance value and a fixed resistance value. One of the ideas of antenna impedance matching is to first reduce the reactance value to radiate more energy, and then perform a transformation of real impedance. In addition, the antenna is served as a balanced structure, and a coaxial feedline is served as an unbalanced structure. To maintain a consistency of currents on an antenna radiating element, the impedance matching circuit is also used to complete a balance-nonbalance conversion. Therefore, in the impedance matching circuit, the antenna is connected in series with an open circuit line 3 to reduce a reactance value in a band, and then an impedance transformation is achieved via a hyperbolic microstrip balun 5. In addition, due to the special structure of the hyperbolic microstrip balun 5, with a balanced structure 52 at one end and an unbalanced structure 53 at the other end, the hyperbolic microstrip balun 5 can act as a balance-nonbalance converter, that is, act as an impedance transformer 51. Usually, a standard impedance value required by a system is 50Ω.

Figure 3:
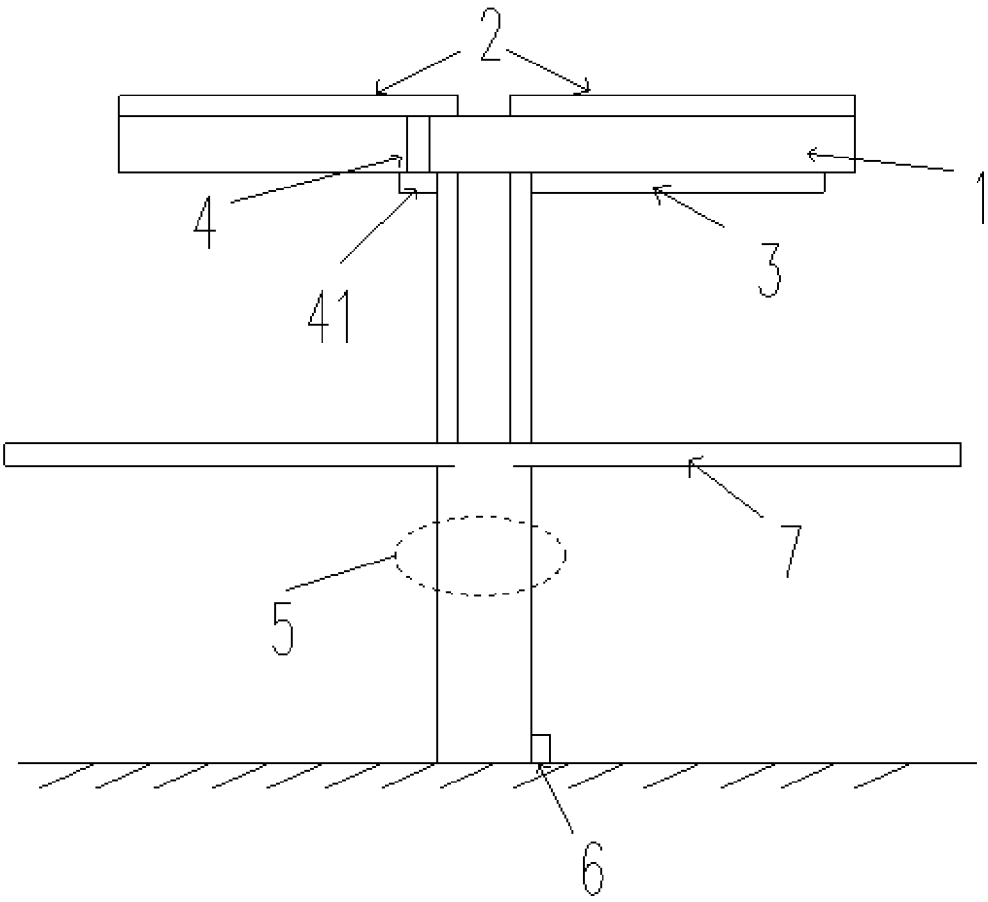
FIG. 3 is a schematic sectional view of an impedance matching unit of an ultra-wideband array antenna according to an embodiment of the present disclosure.
Figure 4:
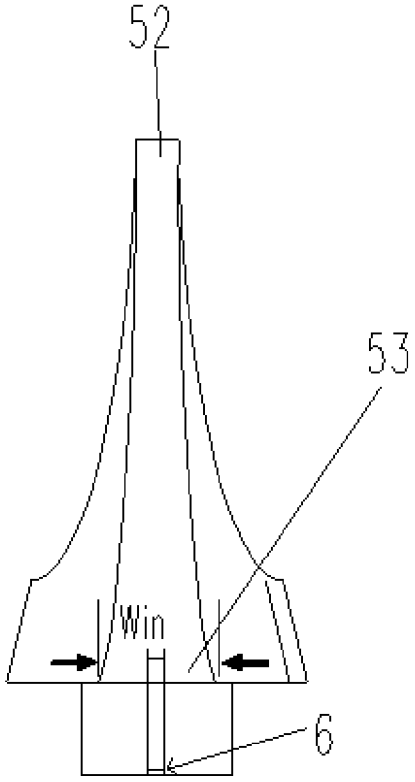
FIG. 4 is a schematic structural diagram of a hyperbolic microstrip balun of the ultra-wideband array antenna according to an embodiment of the present disclosure.
Figure 5:
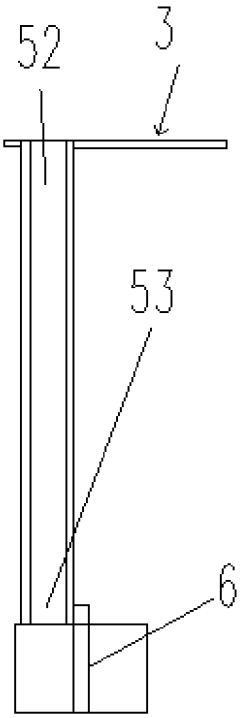
FIG. 5 is a side view of a structure of the hyperbolic microstrip balun of the ultra-wideband array antenna according to an embodiment of the present disclosure.

FIG. 2 to FIG. 5 show a specific implementation of the impedance matching circuit in the ultra-wideband array element according to an embodiment of the present invention, including a dielectric layer 1, and a first circuit layer and a second circuit layer respectively arranged above and below the dielectric layer 1. Wherein, the first circuit layer is a radiator layer 2 of the array antenna. It can be seen that a dipole element, i.e., the impedance matching unit 10, is end-to-end connected at the balanced end to form a tightly coupled arm structure. The second circuit layer is the open circuit line 3 coupled with the radiator layer 2. The open circuit line 3 uses an arm of the dipole as a ground 7, and is directly coupled to the radiator layer 2, sparing the use of the dielectric layer 1. The radiator layer 2 is connected to an arm of the hyperbolic microstrip balun 5 (specifically, an arm of the balanced end 52 of the hyperbolic microstrip balun 5) via a metalized via hole 4 and a metal patch 41. Another arm of the balanced end 52 of the hyperbolic microstrip balun 5 is connected to the open circuit line 3. After a conversion by the hyperbolic microstrip balun 5, an initial end, i.e., the unbalanced end 53 of the hyperbolic microstrip balun 5, is welded to a coaxial line 6. The coaxial line 6 feeds a power to the antenna via the hyperbolic microstrip balun 5. The ground 7 in the middle is used to fix a radiation direction of the array antenna. FIG. 3 is a cross-sectional structure diagram of the impedance matching unit.

Figure 6:
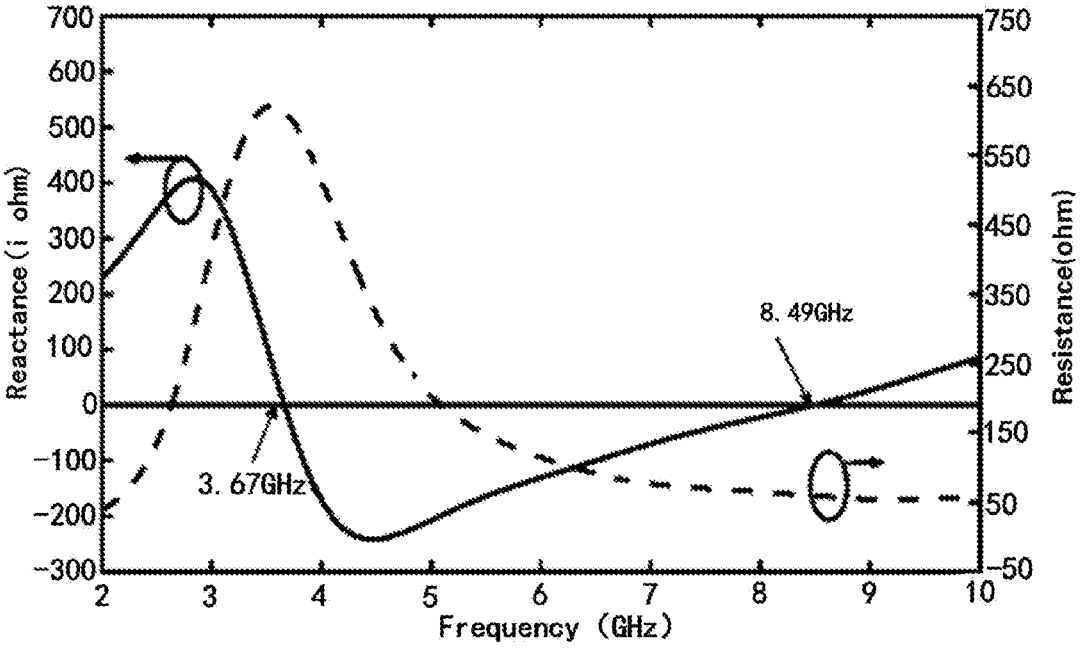
FIG. 6 is an impedance frequency response diagram of the ultra-wideband array antenna according to an embodiment of the present disclosure.

FIG. 6 shows impedance distribution of the ultra-wideband array antenna element in its frequency range. It can be seen from FIG. 6 that the ultra-wideband array antenna element has two resonant frequency point in a band range. Because the resonant frequency point in a low band has a large impedance fluctuation and a high reactance value, this resonant frequency point is preferentially set as a resonant frequency point of the open circuit line 3, thereby determining $\lambda/4$ of the open circuit line 3.

Theoretical analysis: In embodiments of the present disclosure, $\lambda$ is a propagation distance of a vibration signal in a medium in a cycle. Generally, $\lambda$ is related to a frequency and a material of the medium. Generally, a wave speed in the medium meets the following relationship:

$$V_p = \frac{c}{\sqrt{\varepsilon r}},$$

where $V_p$ is a speed of a signal in the medium, c is a speed of light, and εr is a total relative permittivity, generally greater than 1, so that the speed of the signal in the medium is smaller than that in vacuum. Then from Vp=fλ, where f is a frequency of the signal, a wavelength λ of the signal in the cycle may be calculated.

Then from $Z(-l)=-jZ_0 \cot \beta l$, an input impedance formula of the open circuit line 3, it can be known that when a length of the open circuit line 3 is set to λ/4 corresponding to the resonant frequency point, the input impedance is 0, a capacitance characteristic is presented in a low band of the resonant frequency, and an inductance characteristic is presented in a high band of the resonant frequency, which is just the opposite of a reactance characteristic of the antenna, and may be used to reduce the reactance value. Herein, l is a distance between an input end of the open circuit line 3 and an open circuit point, Zo is a characteristic impedance of the open circuit line 3, β is a phase constant, j is a symbol of a complex number, $j^2=-1$, and $\beta=2\pi/\lambda$.

Figure 7:
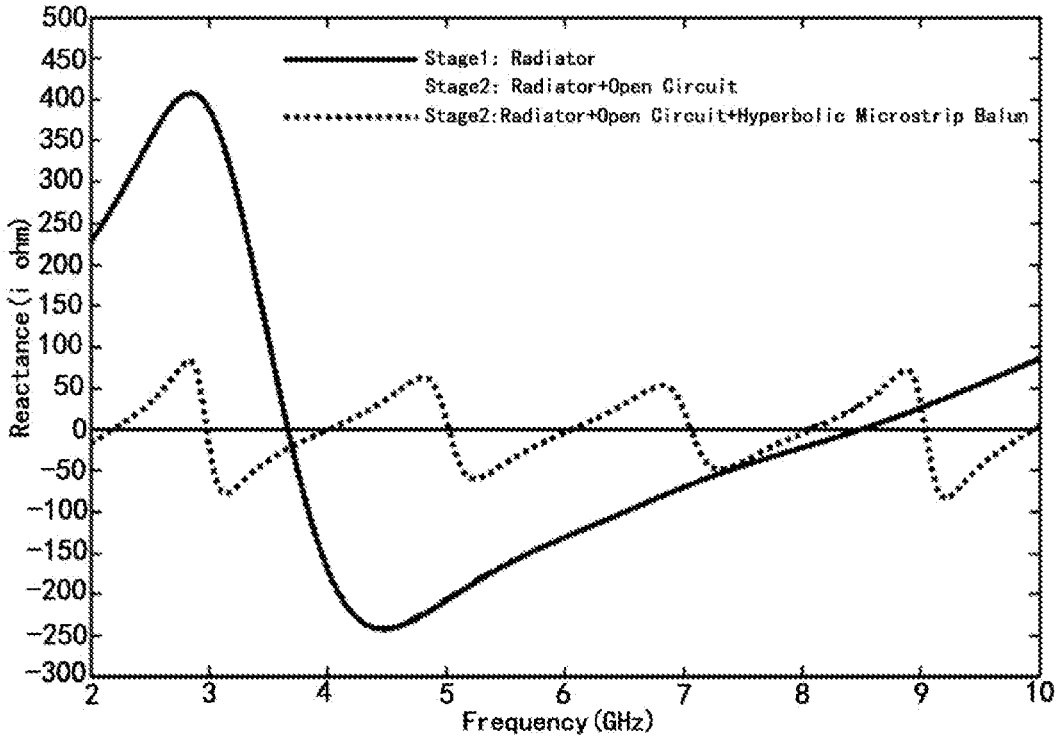
FIG. 7 is a reactance frequency response diagram of the ultra-wideband antenna element in different matching stages according to an embodiment of the present disclosure.
Figure 8:
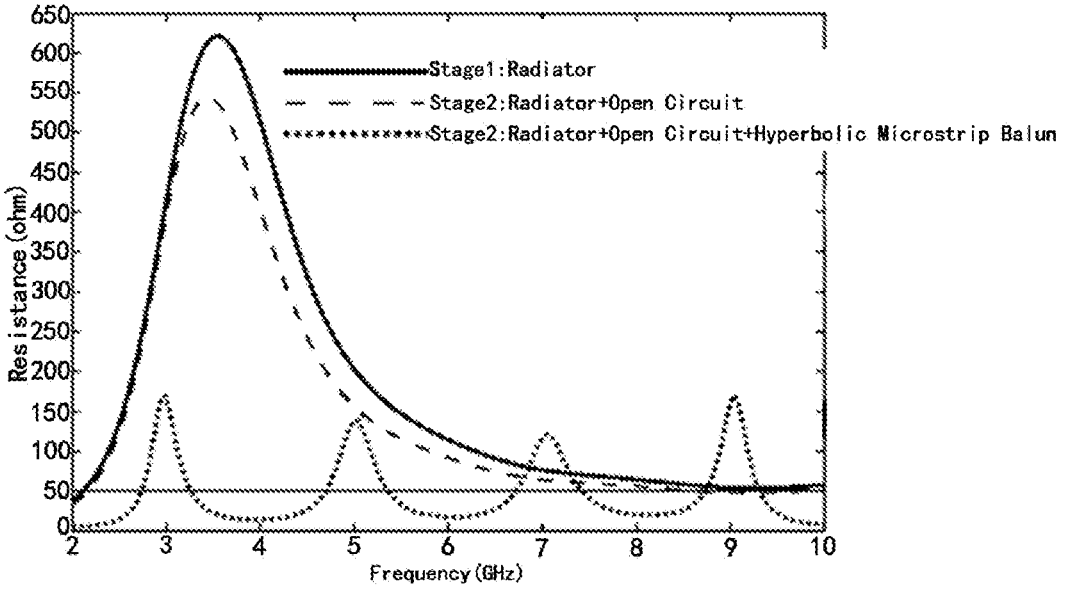
FIG. 8 is a resistance frequency response diagram of the ultra-wideband antenna element in different matching stages according to an embodiment of the present disclosure.

FIG. 7 and FIG. 8 are schematic diagrams illustrating impedance changes of the ultra-wideband array antenna in different matching stages according to an embodiment of the present disclosure. It can be seen that when the antenna is connected in series with the open circuit line 3, the reactance value near the first resonant frequency point decreases, while the reactance value near a high frequency of the antenna increases. The resistance of the antenna also decreases after the antenna is connected in series with the open circuit line 3, which is conducive to the subsequent impedance matching. After the hyperbolic microstrip balun 5 is provided, the reactance value is matched to around 0 ohm, and the real part of the resistance is matched to around 50 ohms, basically realizing the impedance matching within the entire bandwidth, reaching 5.0 times the bandwidth.

Figure 9:
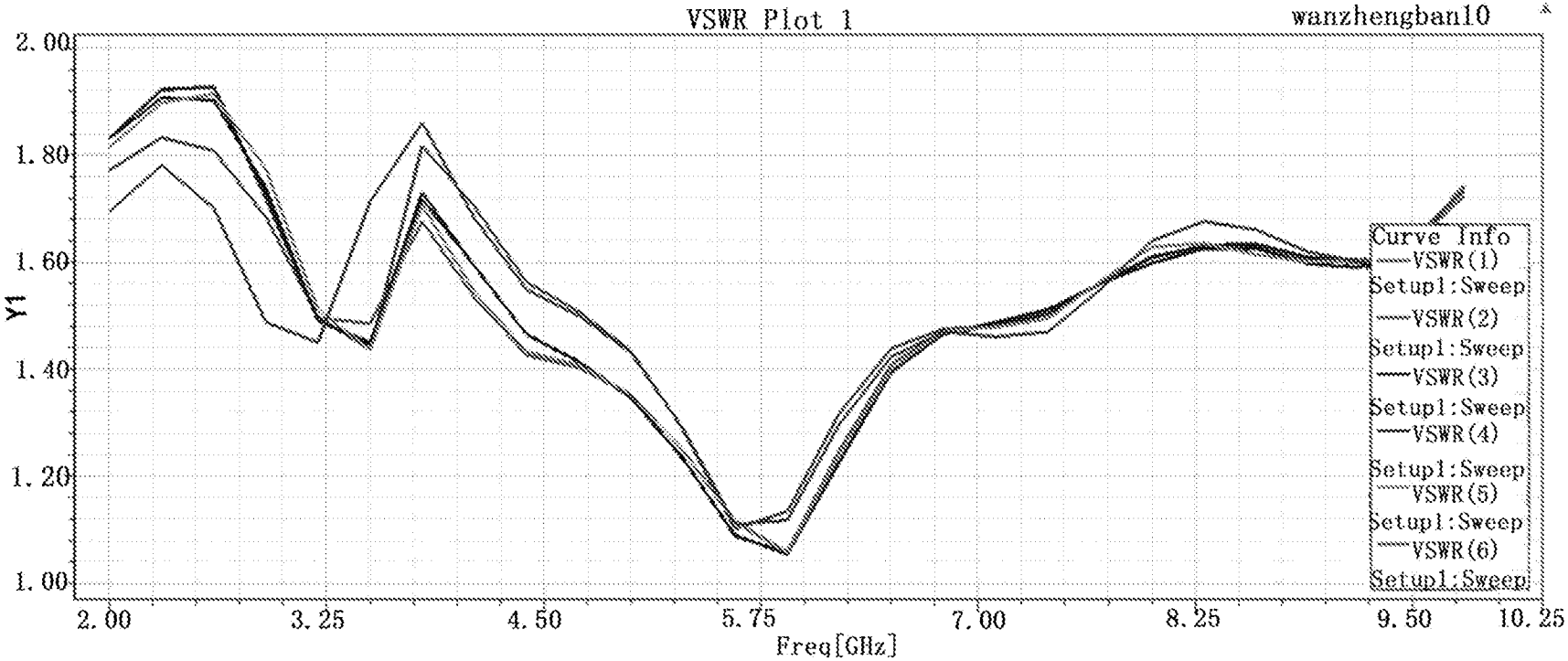
FIG. 9 is a schematic diagram of voltage standing wave ratio (VSWR) parameters of the ultra-wideband array antenna according to an embodiment of the present disclosure.
Figure 10:
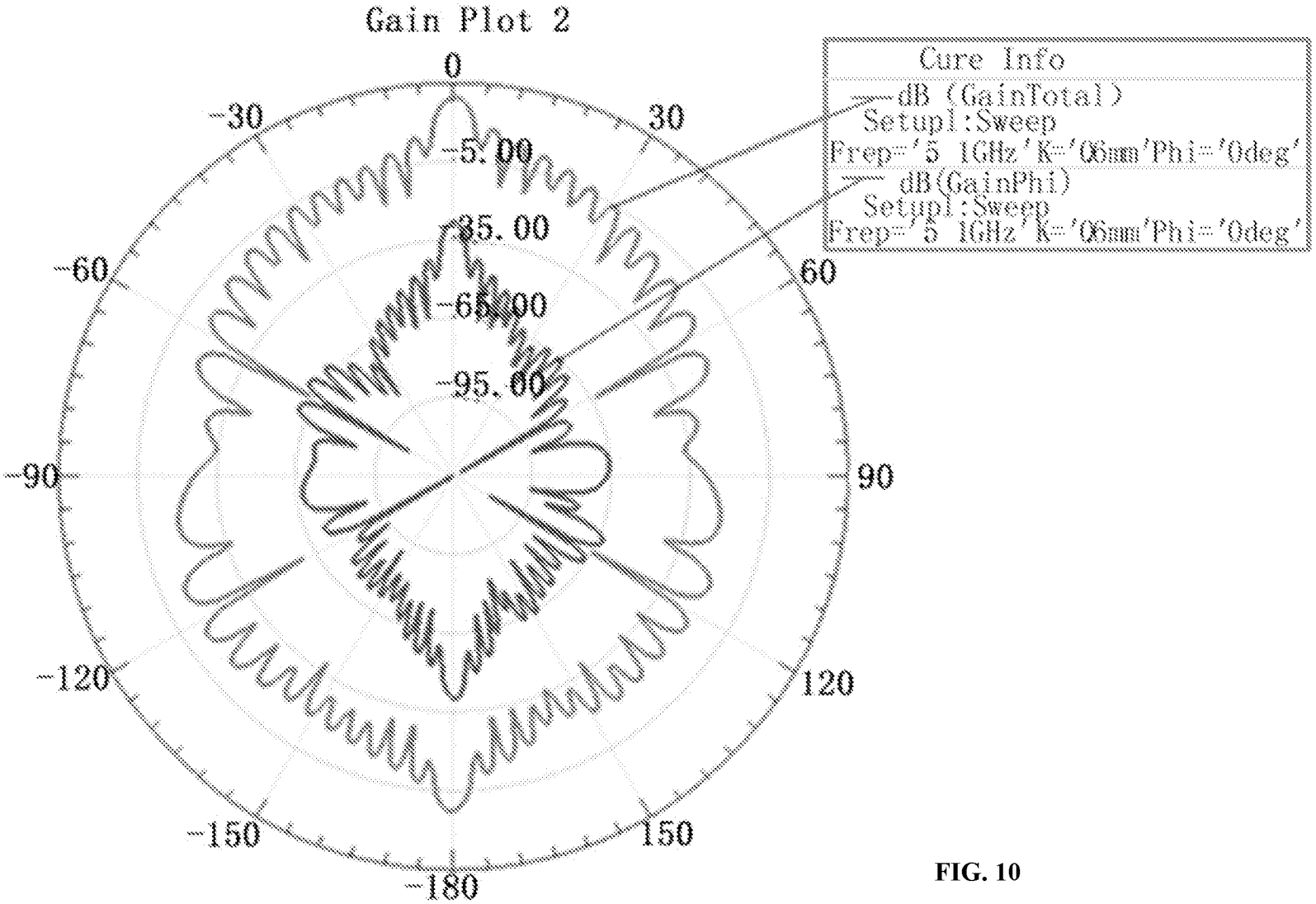
FIG. 10 is a 2D radiation pattern of the ultra-wideband array antenna at a frequency of 5 GHz according to an embodiment of the present disclosure.

Referring to FIG. 9 and FIG. 10, in the embodiments of the present disclosure, a VSWR chart and an antenna radiation pattern may be important indicators to measure antenna impedance matching results and to determine whether the balance-nonbalance conversion is achieved. Generally, for a narrowband antenna, an excellent result may be achieved when VSWR<1.5, and requirements are basically met when VSWR<2.0. For the ultra-wideband array antenna, it can be considered as an ideal situation when VSWR<2.0 within a broadband. As shown in FIG. 9, the VSWR after the matching is less than 2.0, basically meeting the impedance change requirement. In addition, a far-field pattern in FIG. 10 looks good without a large distortion, indicating that the matching circuit has achieved the conversion from the unbalanced end 53 to the balanced end 52.

As can be known from the matching circuit diagram, the impedance of the antenna is taken as the fixed load of the matching circuit, and the reactance part in the antenna impedance is taken as stage 1 of the matching circuit. The reactance is reduced by using the characteristic that the reactance near the resonant frequency point is opposite to the reactance of the antenna when the open circuit line 3 is connected in series. And then the impedance transformation is achieved by the hyperbolic microstrip balun 5. In the antenna element, the open circuit line 3 is integrated to the matching circuit without adding the dielectric layer 1, which simplifies the processing and reduces material costs. The hyperbolic microstrip balun 5, consisting of two gradient microstrip lines, may be divided into the balanced end 52 and the unbalanced end 53. The hyperbolic microstrip balun 5 transforms an unbalanced circuit at a feed port of the coaxial line 6 into a balanced circuit at a feed port of the antenna, without adding an external balun to the circuit for the balance-nonbalance conversion. In addition, due to its gradually changing impedance, the hyperbolic microstrip balun 5 may achieve the transformation between any two impedances in the broadband, thereby achieving the impedance matching in the broadband.

The above are merely preferred embodiments of the present disclosure, and are not intended to limit the present disclosure. Any modification, equivalent substitution and improvement without departing from the spirit and principle of the present disclosure shall be included within the protection scope of the present disclosure.

What is claimed is:

1. An impedance matching method for a low-profile ultra-wideband array antenna, comprising a hyperbolic microstrip balun, a radiator layer, an open circuit line, and a coaxial line, wherein the method comprises: connecting an arm of a balanced end of the hyperbolic microstrip balun in series with the open circuit line; directly coupling the open circuit line to the radiator layer; connecting an other arm of the balanced end of the hyperbolic microstrip balun to the radiator layer via a metallized via hole; and welding an unbalanced end of the hyperbolic microstrip balun to the coaxial line, so that the coaxial line feeds a power to the antenna via the hyperbolic microstrip balun.

2. The method according to claim 1, wherein the arm of the balanced end of the hyperbolic microstrip balun is connected in series with the open circuit line, and the open circuit line is directly coupled to the radiator layer, to form an impedance matching circuit.

3. The method according to claim 1, wherein the open circuit line and the radiator layer share a same dielectric layer.

4. The method according to claim 3, wherein the open circuit line and the radiator layer are electromagnetically coupled.

5. The method according to claim 1, wherein the hyperbolic microstrip balun has a curvilinear structure.

* * * * *